United States Patent [19]

Todd

[11] Patent Number: 4,813,657

[45] Date of Patent: Mar. 21, 1989

[54] CUTTING APPARATUS CLAMP DEVICE AND METHOD OF USING SAME

[76] Inventor: Thomas W. Todd, 10161 Royal Ann Ave., San Diego, Calif. 92126

[21] Appl. No.: 112,951

[22] Filed: Oct. 26, 1987

[51] Int. Cl.[4] ..... B25B 11/00

[52] U.S. Cl. ..... 269/22; 269/329

[58] Field of Search ..... 269/22, 25, 249, 266; 254/93 HP; 92/90, 93, 94, 96, 103 F, 104, 35

[56] References Cited

U.S. PATENT DOCUMENTS

| | | | |
|---|---|---|---|
| 2,852,463 | 9/1958 | Gutzmer | 269/22 |
| 3,237,252 | 3/1966 | Ratcliffe | 269/25 |
| 3,997,152 | 12/1976 | Sass et al. | 269/249 |
| 4,014,311 | 3/1977 | Steere | 269/22 |
| 4,034,971 | 7/1977 | Tsuyama | 269/249 |
| 4,643,408 | 2/1987 | Stoll | 269/22 |
| 4,687,189 | 8/1987 | Stoll et al. | 269/22 |

*Primary Examiner*—Robert C. Watson
*Attorney, Agent, or Firm*—Bernard L. Kleinke

[57] ABSTRACT

A clamp device for retaining a side marginal edge of a work piece during a cutting operation, which includes an elongated frame standing along substantially the entire side marginal edge of the work piece, for receiving it during the cutting operation. The clamp device also includes an adjustable upper gripping element which is retained releasably within the frame, and which extends along substantially the entire length thereof, for engaging frictionally the back side of the side marginal edge of the work piece. A lower gripping element is disposed inside the frame, and extends along substantially the entire length thereof, for engaging frictionally the underside of the marginal edge of the work piece. The upper gripping element includes an inflatable bladder for engaging the frame, and an elongated rail, which depends integrally from the bladder, for engaging frictionally the side marginal edge of the work piece, and for pressing it downwardly against the lower gripping element. The method of using the clamp device comprises placing the lower gripping element inside the frame, inserting the work piece inside the frame, between the upper and lower gripping elements, and inflating the bladder to cause the rail to move downwardly into frictional engagement with the work piece, and to press it against the lower gripping element.

18 Claims, 2 Drawing Sheets

10
15
51
79
32
24
50
25
163
44
76
90
81
20
26
85
30
35
36
17
23
83
19
87
92
62

9
11
13
ℓ
S
20
1
1
10

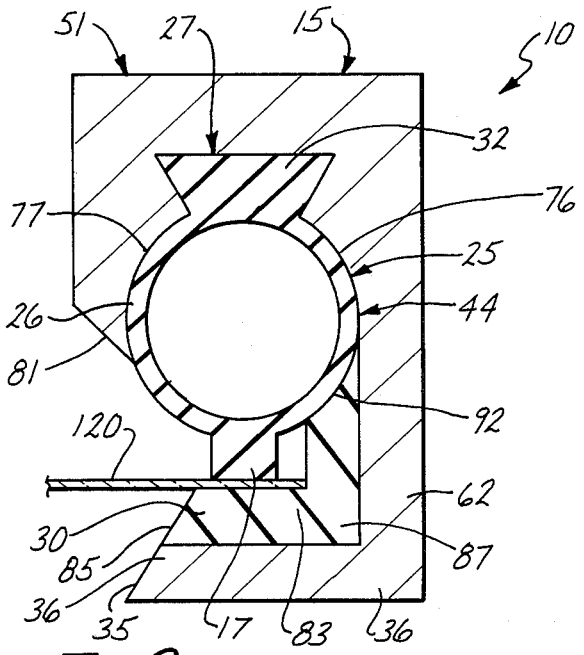
FIG. 2
FIG. 3
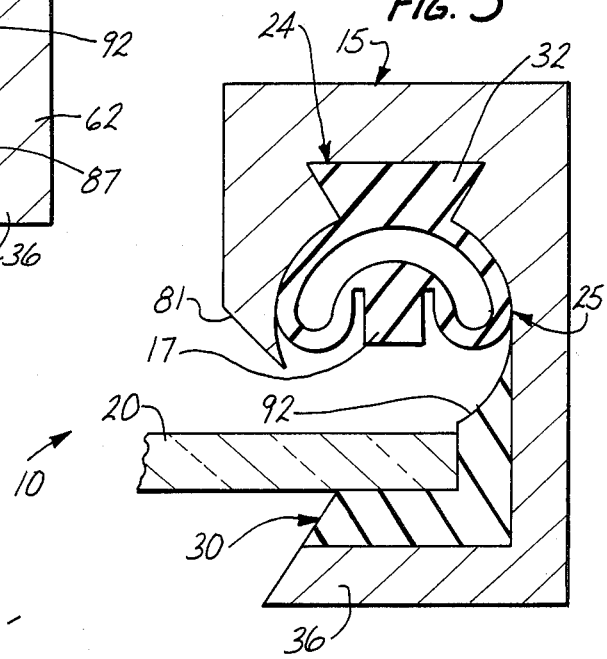
FIG. 4
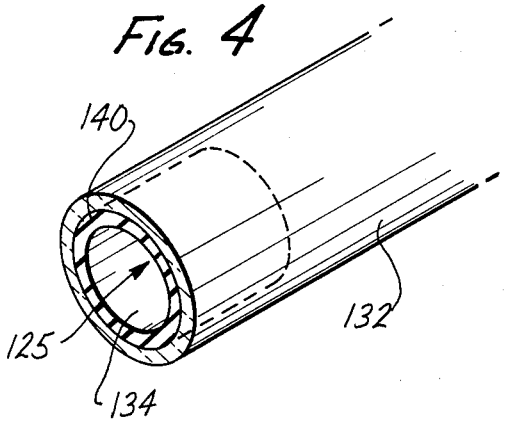
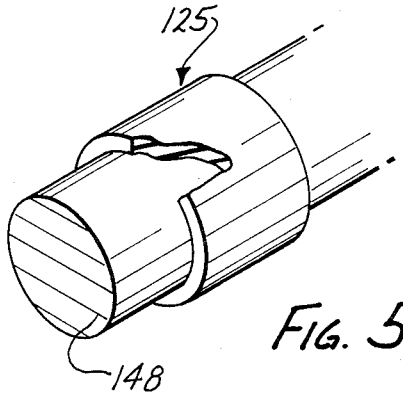
FIG. 5

CUTTING APPARATUS CLAMP DEVICE AND METHOD OF USING SAME

DESCRIPTION

1. Technical Field

The present invention relates in general to cutting apparatus such as water jet, flame or laser cutting equipment. The present invention relates more particularly to a cutting apparatus clamp device and a method of using it, for receiving securely and adjustably a work piece for cutting operations.

2. Background Art

Conventional techniques for cutting work pieces such as glass panels, metal sheets or other materials, include subjecting a work piece to a jet of fluid, such as a jet of water, under very high pressure. Other conventional cutting techniques include flame cutting, such as gas plasma cutting or laser cutting.

When the cutting jet or beam impinges upon the work piece, the jet causes the work piece to shift into an undesired position, thus damaging the work piece. In some cutting applications, the work piece is moved relative to the fixed cutting apparatus, for achieving a complex predesigned pattern. Thus, several conventional clamping devices and techniques have been used in an attempt to cause the movement of the work piece to be controlled accurately during the cutting operations.

One such attempted technique includes using high pressure point contact clamps with ball joint screw clamps and pneumatic or hydraulic levers. While such an attempt could reduce the shifting of the work piece during cutting operations, it has proven to be less than totally satisfactory, in that it has caused other problems. In this regard, the conventional use of several high pressure point contacts between the clamps and the work piece, for obtaining a sufficient holding force, have caused the work piece to be damaged. The high pressure point contacts deform the work piece by causing undesirable and unwanted impressions and indentations to be formed thereon. Therefore, while the conventional high pressure point contact clamps have addressed the shifting problem of the work piece during cutting operations, they have presented unacceptable and unsatisfactory results, by causing the surface of the work piece to be deformed, indented or otherwise damaged.

In particular applications, such as in the aerospace defense and military industries, the skin or outer surface of the craft or other airborne devices such as missiles, are required to be smooth and free of any undesired indentations, impressions or defects. Thus, the conventional high pressure contact clamp devices do not present an acceptable, nor a satisfactory solution to the concerns associated with cutting operations in this particularly important industry.

Therefore, it would be highly desirable to have a clamp device and method of using it, for overcoming the problems associated with using high energy, high pressure conventional cutting techniques. Such clamp device and method of using it should greatly reduce, if not eliminate entirely, slippage and shifting of the work piece during cutting operations, while protecting it from damages, and undesired impressions or indentations.

The conventional clamp mechanism is an intricate and complete mechanism, and it generally includes a large number of moving parts, such as mechanical joints and bearings. Therefore, the conventional clamp device is relatively difficult to operate, in that such a device requires skilled personnel to make adjustments properly for the particular shape of the work piece to be cut.

Therefore, it would be highly desirable to have a new and improved clamp device and method of using it, for overcoming the problems associated with the intricacy and complexity of the conventional clamping devices and techniques. In this respect, the inventive clamp device should have minimal moving parts, and it should be operable by novice, inexperienced, as well as physically impaired operators.

Another problem which faces the clamp device of the prior art is that the numerous moving parts utilized thereby, are readily susceptible to damage such as wear and rust, caused by the backsplash of debris and excess fluid during the cutting operations. One attempted solution has been to use rust proof aluminum parts. This attempt has proven to be less than completely satisfactory, in that the aluminum parts tend to wear easily under the abrasive effect of the backsplashed debris.

Another attempted solution which has also proven to be less than satisfactory, is the use of stainless steel parts. The stainless steel parts generally render the clamping device very expensive to manufacture. Such expense is not justifiable for some applications.

Therefore, it would be highly desirable to have a clamp device which does not wear or rust readily under the abrasive impact of the debris of the jet of fluids used in the cutting operations. The inventive clamp device should be relatively inexpensive to operate, to use and to incorporate into existing cutting systems.

The foregoing problems associated with the conventional clamp devices and techniques of the prior art are compounded further when the work pieces to be retained by the clamp device during cutting operations, have irregular and complex shapes, or are relatively heavy and thick. In which event, the operator is forced to adjust the mechanical parts clamping device for the thickness of every individual work piece. Thus, the set up time for the cutting operation is relatively long, and the adjustment process is tedious and awkward, also, such conventional devices require skilled personnel to operate them.

Moreover, when the work piece includes such complex irregularities, additional high pressure points of contact are employed to retain the work piece, and to control its movement during the cutting operations. The pressure exerted by the points of contact is not uniformly distributed over the surface of the work piece in that the raised portions of the surface are exposed to a higher pressure than the lower portions. Thus, the excess pressure on the raised portions further indents and damages the work piece.

Yet another concern of the prior art in connection with the use of point contacts, is that these contacts do not engage the work piece securely, and the work piece tends to slip, especially when it is subjected to a high pressure. The conventional solution to this slippage problem has been to tighten the point contacts to cause the clamp device to grip the work piece further. Such attempt has proven to be less than entirely satisfactory, in that the increased localized pressure causes additional damage to the work piece.

Therefore, it would be highly desirable to have a new and improved clamp device which is adaptable to receive work pieces of various shapes, weights and thicknesses, without making undesirable impressions thereon, and without damaging such work pieces. The inventive method of using the clamp device should not require a long adjustment set up time.

Another attempted solution to the concerns associated with the prior art, includes using a rubber belt and rollers, and placing the work piece therebetween, for causing it to move in a desired direction. This attempt has also proven to be unsatisfactory, in that the rubber belt tends to stretch and to cause slippage and damage to the work piece. Also, when using water under pressure as the cutting jet, the backsplashed debris infiltrates between the belt and the work piece, as well as between the work piece and the rollers, and causes the cutting operation to become uncontrollable and imprecise.

Therefore, it would be highly desirable to have a new and improved clamp device which reduces greatly, if not eliminates totally the slippage problem, and which renders the cutting operation precise and controllable.

DISCLOSURE OF INVENTION

Therefore, the principle object of the invention is to provide a new and improved cutting apparatus clamp device, and method of using it, for preventing the slippage and shifting of the work piece during the cutting operations.

Another object of the present invention, is to provide a new and improved cutting system clamp device, and method of using it, for protecting the work piece from damage or indentation, during the cutting operations.

Yet, another object of the present invention, is to provide such a new and improved cutting system clamp device, which greatly reduces the set up adjustment time, and which accommodates work pieces of various thicknesses, weights, and irregularities.

Briefly, the above and further objects and features of the present invention are realized by providing a new and improved clamp device for retaining a side marginal edge of a work piece during a cutting operation, which includes an elongated frame standing along substantially the entire side marginal edge of the work piece, for receiving it during the cutting operation. The clamp device also includes an adjustable upper gripping element which is retained releasably within the frame, and which extends along substantially the entire length thereof, for engaging frictionally the back side of the side marginal edge of the work piece. A lower gripping element is disposed inside the frame, and extends along substantially the entire length thereof, for engaging frictionally the underside of the marginal edge of the work piece.

The upper gripping element includes an inflatable bladder for engaging the frame, and an elongated rail, which depends integrally from the bladder, for engaging frictionally the side marginal edge of the work piece, and for pressing it downwardly against the lower gripping element.

The method of using the clamp device comprises placing the lower gripping element inside the frame, inserting the work piece inside the frame, between the upper and lower gripping elements, and inflating the bladder to cause the rail to move downwardly into frictional engagement with the work piece, and to press it against the lower gripping element.

In the preferred form of the invention, the work piece is retained and engaged frictionally by and between the bladder and the pad member, to reduce greatly, if not to eliminate entirely slippage and shifting of the work piece during cutting operations. Furthermore, the engagement of the work piece between the pad member and the rail, protects the work piece from damages and undesired impressions or indentations, in that both the elongated pad member and rail cause a uniformly distributed pressure to be exerted along the side marginal edge of the work piece.

Due to the elastomeric composition of the bladder and the pad member, the clamp device does not wear or rust readily under the abrasive impact of the debris of jet fluids used in the cutting operations. Also, the inflatable bladder is adaptable to receive and to engage work pieces of various shapes, weights, and thicknesses, without making undesirable impressions thereon, and without damaging such work pieces. The resilient composition of the rail, and of the pad member, enables the device to retain work pieces having irregular and complex shapes, without causing damages thereto.

The present inventive clamp device is very simple to use, even by inexperienced or physically impaired operators. Furthermore, the inventive clamp device is relatively inexpensive to manufacture and to incorporate into existing cutting apparatus. In this respect, the inventive clamp device has minimal moving parts, which do not rust readily, and which require short adjustment set up time and maintenance.

In another form of the invention, a generally tubular bladder is used to engage work pieces having complex and irregular shapes, such as a hollow tubular or rodlike work pieces.

Thus, the inventive clamp device and method of using it, overcome the problems associated with using high energy, high pressure conventional cutting techniques. The clamp device reduces, if not eliminates entirely, slippage and shifting of the work piece during cutting operations, while protecting it from damages, and undesired impressions or indentations.

The inventive clamp device and method of using it, further overcomes the problems associated with the intricacy and complexity of the conventional clamping devices and techniques. The inventive clamp device has minimal moving parts, and is operable by novice, inexperienced, as well as physically impaired operators.

The inventive clamp device does not tend to wear or to rust readily under the abrasive impact of the debris of the jet of fluids used in the cutting operations. The clamp device is relatively inexpensive to operate, to use, and to incorporate into existing cutting systems.

The clamp device of the present invention is adaptable to receive work pieces of various shapes, weights and thicknesses, without making undesirable impressions thereon, and without damaging such work pieces. The inventive method of using the clamp device, does not require a long adjustment set up time. Furthermore, the improved clamp device reduces greatly, if not eliminates totally the slippage problem, and renders the cutting operation precise and controllable.

BRIEF DESCRIPTION OF DRAWINGS

The above mentioned and other objects and features of this invention and the manner of attaining them will become apparent, and the invention itself will be best understood by reference to the following description of the embodiments of the invention in conjunction with the accompanying wherein:

FIG. 2 is a cross-sectional side elevational view of the clamp device of FIG. 1, shown retaining a relatively thin work piece;

FIG. 3 is a cross-sectional side elevational view of the clamp device of FIG. 1, shown in a retracted position;

FIG. 4 is a cross-sectional, pictorial view of another clamp device, which is also constructed according to the present invention, and which is shown retaining an elongate hollow tubular work piece; and FIG. 5 is a somewhat enlarged scale fragmentary pictorial view of the clamp device of FIG. 4, which is shown retaining a work piece having a rod-like shape.

BEST MODE FOR CARRYING OUT THE INVENTION

Figure 1:
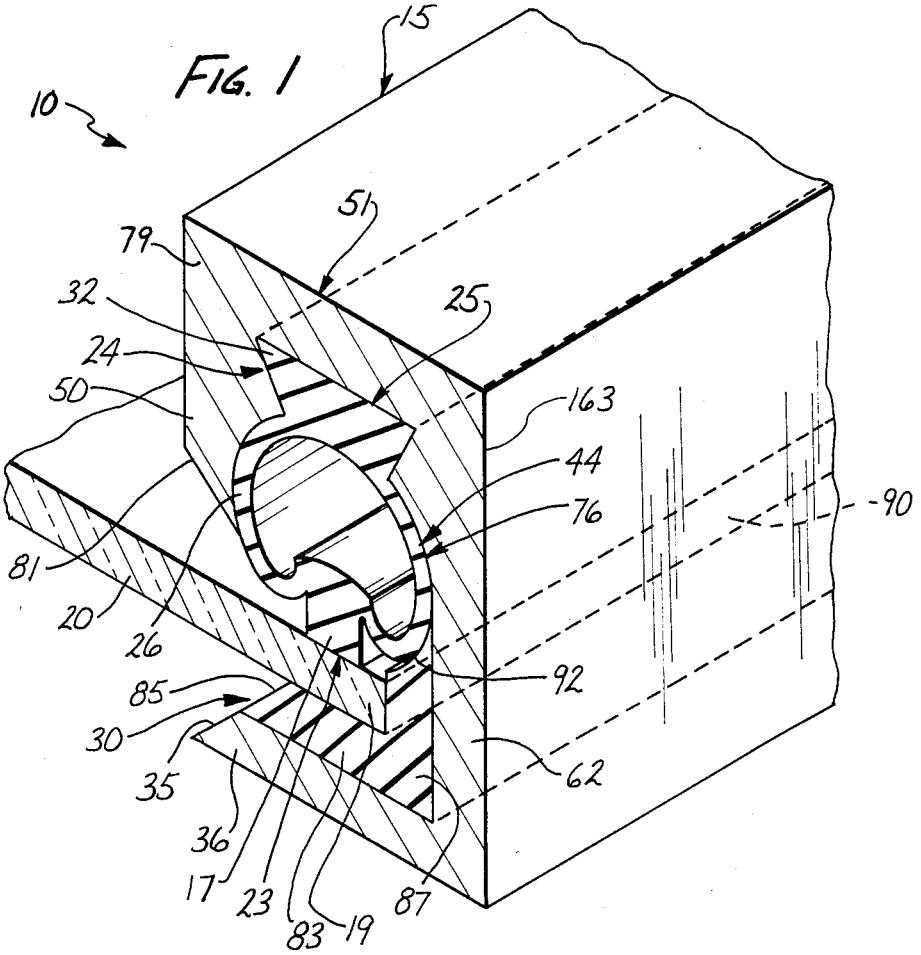
FIG. 1 is a cross-sectional fragmentary pictorial view of a cutting, apparatus clamp device, which is constructed according to the present invention, shown retaining a relatively thick work piece.
Figure 1A:
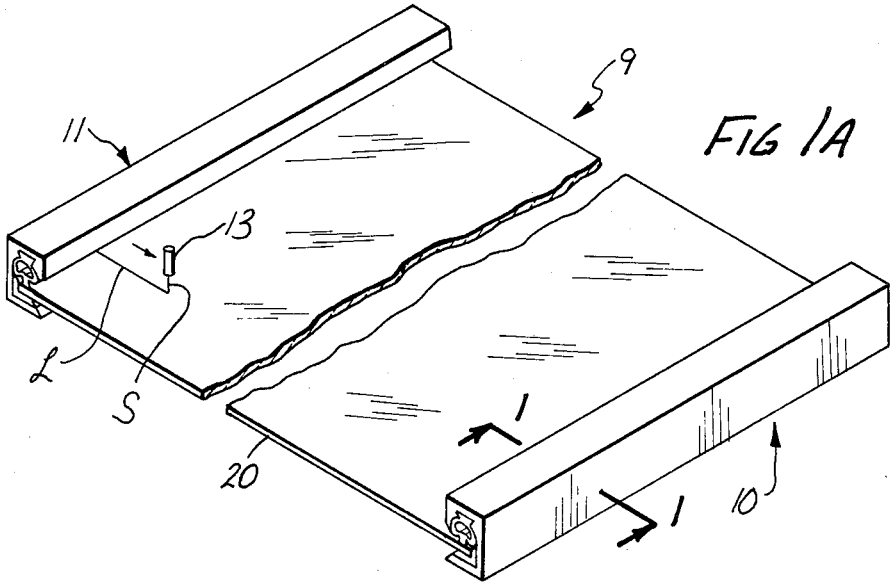
FIG. 1A is a reduced scale, fragmentary view of the apparatus clamp device of FIG. 1, showing a similar such clamping device for securing opposite marginal edges of a work piece therebetween.

Referring now to the drawings, and more particularly to FIG. 1A thereof, there is shown a cutting apparatus 9, having a pair of generally similar elongated clamp devices 10 and 11, which are constructed in accordance with the present invention. The devices 10 and 11 grip the opposite side marginal edges of a work piece, such as a sheet of glass 20 for retaining the work piece during the cutting operations.

A cutting nozzle 13 provides a jet of fluid, such as water, having entrained abrasive particles for cutting a line L in the sheet, as the nozzle moves relative to the sheet 20. While in the preferred form of the invention, the nozzle 13 moves relative to the sheet 20, it will become apparent to those skilled in the art, after reviewing the disclosure of the invention, that the nozzle 13 and the work piece 20 can move relative to one another. Therefore, either the nozzle 13 or the work piece 20 or both can move, and either one can remain stationary relative to the other. The means for moving the nozzle 13 is conventional, and thus is not shown.

Considering now the inventive clamps 10 and 11 in greater detail, with reference to FIGS. 1–3, the clamps 10 and 11 being generally similar to one another, only the clamp 10 will hereinafter be described in greater detail. The clamp 10 generally includes an elongated channel-shaped frame 15 which extends along, and receives substantially the entire side marginal edge 19 of the work piece 20.

A pair of upper and lower gripping elements 24 and 30 are disposed inside, and extend along, substantially the entire length of the frame 15, for engaging frictionally the side marginal edge 19, to hold and retain the sheet 20 securely relative to the nozzle 13. The lower gripping element 30 is a fixed element, while the upper gripping element 24 is adjustable relative to the thickness of the work piece 20. The upper gripping element 24 includes a bladder 25, which is inflatable to cause an integral depending rail 17 to move downwardly into engagement with the work piece 20.

In use, the work piece 20 is inserted between the upper and lower gripping elements 24 and 30. The bladder 25 is then inflated by air under pressure from a suitable source of compressed air (not shown) by a valve (not shown), to cause the rail 17 to move downwardly into engagement with the work piece 20, and to press it against the lower gripping element 30.

Considering now the frame 15 in greater detail, with respect to FIG. 1, it is generally channel-shaped, and has a unitary structure and rigid metallic composition. The frame 15 includes a pair of elongated lower and upper leg portions 36 and 51, and an elongated interconnecting bight portion 62.

The lower leg portion 36 terminates in a chamfered edge 35 to help guide the work piece 20 into position inside the frame 15. The bight portion 62 depends at a generally right angle from, and cooperates with, the lower leg portion 36, to support the work piece 20. The upper leg portion 51 has an elongated cut-out portion, generally indicated at 44, for receiving and retaining a complementary shaped upper gripping element 24.

As illustrated in FIGS. 1–3, the upper gripping member 24 has a unitary construction and a flexible composition, and it is deformed to press against, and to retain work pieces of different thicknesses. The upper gripping member 24 generally includes an inflatable bladder 25 which is retained releasably into the cut-out portion 44, inside the frame 15.

An elongated rail 17 which is generally rectangular in cross-section and of a resilient composition, depends integrally downwardly from the bladder 25, and extends substantially along the entire side marginal edge 19 of the work piece 20 to engage it frictionally. The rail 17 has a generally flat underside 23, for causing the pressure to be applied substantially continuously, uniformly along the entire side marginal edge 19. Thus, even though the work piece 20 may present irregularities along its side marginal edge 19, the resilient composition of the rail 17 permits it to deform and to be shaped complementary with the irregularities of the work piece 20.

The bladder 25 is elongated and hollow throughout its axial length. It extends substantially the entire length of the frame 15, and it is made of flexible elastomeric material such as rubber. The bladder 25 includes a key portion 32, which fits snugly into a complimentary sized keyway portion 27 in the cut-out portion 44. The key portion 32 is generally diametrically opposed to the rail 17.

The bladder 25 further includes an intermediate portion 26 which interconnects integrally the key portion 32 and the rail 17. When the bladder 25 is fully inflated, such as when the clamp 10 is used to retain a substantially thin work piece 120 (FIG. 2), the intermediate portion 26 is generally circular in cross-section.

When the bladder 25 is in a retracted position, such as when it is not in use (FIG. 3), the intermediate portion 26 is generally semi-circular in cross-section. When, on the other hand, the work piece is relatively thick, such as the sheet of glass 20 shown in FIG. 1, the bladder 25 is in a partially inflated position, and the intermediate portion 26 is generally cardioidal in cross-section. Thus, the clamp 10 can accommodate work pieces having various thicknesses and irregularities, without causing the surface thereof to be damaged or indented.

In order to retain and receive the bladder 25, the cut-out portion 44 of the upper leg portion 51 includes an outer arcuate concave shoulder 76 and an inner arcuate shoulder 77, which are disposed symmetrically on the opposite sides of the keyway portion 27. The upper leg portion 51 terminates inwardly in an upright retaining member 79 for receiving a part of the intermediate portion 26. The retaining member 79 terminates in a chamfered edge 81 which help guide the work piece 20 into position inside the clamp device 10. The chamfered edge 81 extends beyond the upper quadrant of the intermediate portion 26 of the bladder 25, to retain the bladder 25 in position, and to limit and guide its deformation when it is being inflated.

An L-shaped pad member 30 of a unitary construction and resilient composition, such as rubber, supports the work piece 20, and retains it frictionally, during the cutting operation. The pad member 30 includes a horizontal leg portion 83 for supporting the underside of the side marginal edge 19 of the work piece 20.

The horizontal leg portion 83 has a chamfered edge 85 to help guide the work piece 20 into position inside the frame 15. The chamfered edge 85 is disposed generally coplanarly with the chamfered edge 35 of the lower leg portion 36, to provide a continuous flat surface which helps guide the work piece 20 smoothly atop the horizontal leg portion 83.

The horizontal leg portion of the pad member 30, depends into an upright member 87, for engaging frictionally the side 90 of the marginal edge 19, to protect the work piece 20 from the lateral shifts in position during the cutting operations. The upright member 87 terminates in an arcuate or low-shaped concave edge 92, having a complementary curvature to, and coordinating with the outer arcuate concave shoulder 76, to form a continuous small wall therewith, for receiving and retaining a part of the intermediate portion 26.

Thus, the special generally cylindrical configuration of the inner arcuate shoulder 77, the outer arcuate shoulder 76, and the arcuate concave edge 92, limit and guide the deformation of the bladder 25 to a generally cylindrical shape, in order to obtain a uniform pressure distribution along the inner periphery of the bladder 25, for optimizing the pressure applied to the work sheets 20 (FIG. 1) or 120 (FIG. 2).

FIGS. 4 and 5 show another clamp device 125, which is constructed in accordance with the present invention. The device 125 is used for supporting, gripping and protecting work pieces of complex and irregular shapes, such as the hollow tubular work piece 130 or a rod-like work piece 148. In this regard, the work piece 130 includes a hollow elongated tubular member 132, having an opening 134 which extends partially or totally along its axial length. The clamp device 125 includes an inflatable bladder 140 having similar composition to that of the clamp devices 10 and 11. The bladder 140 has a generally elongated tubular shape, which extends partially inside the opening 134. Another clamp (not shown) is used to support the other end of the work piece 132, for retaining it frictionally and securely during the cutting operations.

FIG. 5 illustrates the clamp 125 in use for supporting, for frictionally gripping and protecting a rod-like work piece 148. In use, the bladder 140 engages the external periphery of the work piece 148 for retaining it. Another clamp (not shown) is used to support the other end of the work piece 148.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A clamp device for retaining a plate work piece by its side marginal edge during a cutting operation, comprising:

an elongated frame extending along a marginal edge of the work piece, for receiving it during the cutting operation;

an upper gripping means disposed on said frame for engaging frictionally the opposite side marginal edge of the work piece;

a lower gripping means disposed on said frame opposite said upper gripping means for engaging frictionally said opposite marginal edge of the work piece;

at least one of said upper and lower gripping means including a hollow inflatable bladder being retained movably on said frame, said bladder includes an integral elongated rail portion being composed of resilient material and said rail portion being movable toward the approximate geometric center of the transverse cross sectional area of said bladder when said bladder is deflated, for releasing the marginal edge of a retained work piece and being movable away from said approximate center of said bladder when said bladder is being inflated for engaging frictionally the marginal edge of the work piece and pressing it releasably against the opposite gripping means to support releasably said workpiece in a horizontal disposition; and said rail portion having a generally flat underside adapted to apply a substantially uniform pressure along the side marginal edge of the work piece.

2. A clamp device according to claim 1, wherein said frame is channel-shaped throughout its entire axial length.

3. A clamp device according to claim 2, wherein said frame has a unitary structure, and includes a pair of elongated lower and upper leg portions, and an elongated bight portion.

4. A clamp device according to claim 3, wherein said lower leg portion terminates in a chamfered edge to help guide the work piece into position inside said frame.

5. A clamp device according to claim 3, wherein said upper leg portion has an elongated cut-out portion for receiving and retaining said upper gripping means.

6. A clamp device according to claim 3, wherein said upper gripping means has a unitary construction and a flexible resilient composition, for deforming to press against, and to retain, work pieces of different thicknesses.

7. A clamp device according to claim 7, wherein said bladder is elongated and hollow throughout its axial length.

8. A clamp device according to claim 7, wherein said bladder includes a key portion adapted to fit snugly into a complementary seized keyway portion in said upper leg portion.

9. A clamp device according to claim 8, wherein said bladder further includes an intermediate portion for interconnecting integrally said key portion and said rail.

10. A clamp device according to claim 9, wherein said bladder is made of flexible elastomeric material.

11. A clamp device according to claim 10, wherein said elastomeric material is rubber.

12. A clamp device according to claim 9, wherein said intermediate portion is adapted to inflate into a generally cylindrical configuration.

13. A clamp device according to claim 12, wherein said upper leg portion terminates inwardly in an upright retaining member for receiving a part of said intermediate portion.

14. A clamp device according to claim 13, wherein said retaining member terminates in a chamfered edge for helping guide the work piece into position inside the clamp device.

15. A clamp device for retaining a side marginal edge of a work piece during a cutting operation, comprising:

an elongated frame extending along a marginal edge of the workpiece, for receiving it during the cutting operation;

an upper gripping means being retained movably on said frame for engaging frictionally the opposite side marginal edge of the work piece;

a lower gripping means disposed on said frame opposite said upper griping means for engaging frictionally said opposite marginal edge of the work piece; and at least one of said upper and lower gripping means including an inflatable bladder for engaging said work piece and pressing it releasably against the opposite gripping means; and said lower gripping means includes a generally L-shaped pad member of a resilient composition, for supporting and engaging frictionally the side marginal edge of the work piece.

16. A clamp device according to claim 15, wherein said L-shaped pad member includes a horizontal leg portion for supporting and engaging the underside of the side marginal edge, and an upright member depending integrally from said horizontal leg portion;

said horizontal leg portion has chamfered edge to help guide the work piece into position inside said frame; and said upright member terminates in an arcuate concave edge for retaining said bladder.

17. A method of using a clamp device for retaining a plate work piece by its side marginal edge during a cutting operation comprising:

using an elongated frame extending along a marginal edge of the work piece for receiving the work piece during the cutting operation;

using an upper gripping means disposed on said frame for engaging frictionally the opposite side marginal edge of the work piece;

using a lower gripping means disposed on said frame opposite said upper gripping means for engaging frictionally said opposite marginal edge of the work piece; and inflating a bladder having an elongated rail portion depending integrally from said bladder to cause said rail to move into frictional engagement with the work piece and to press it against the gripping means opposite said rail.

18. A method according to claim 17, further including the steps of deflating said bladder, and removing the work piece from said bladder.

* * * * *

UNITED STATES PATENT AND TRADEMARK OFFICE

CERTIFICATE OF CORRECTION

PATENT NO. : 4,813,657

DATED : March 21, 1989

INVENTOR(S) : Thomas W. Todd

It is certified that error appears in the above-identified patent and that said Letters Patent is hereby corrected as shown below:

In column 8, line 48 please delete "claim 7" and substitute therefor -- claim 6--.

In column 9, line 15 please delete "griping" and substitute therefor -- giripping --.

Signed and Sealed this

Thirty-first Day of October, 1989

*Attest:*

DONALD J. QUIGG

*Attesting Officer*

*Commissioner of Patents and Trademarks*